United States Patent [19]

Liberman

[11] 4,427,962

[45] Jan. 24, 1984

[54] LOW PROFILE TRANSFORMER BOBBIN

[75] Inventor: Arnold J. Liberman, Skokie, Ill.

[73] Assignee: Zenith Radio Corporation, Glenview, Ill.

[21] Appl. No.: 371,689

[22] Filed: Apr. 26, 1982

[51] Int. Cl.[3] ..... H01F 15/10

[52] U.S. Cl. ..... 336/192; 336/208

[58] Field of Search ..... 336/198, 208, 192; 310/71

[56] References Cited

U.S. PATENT DOCUMENTS

| | | | |
|---|---|---|---|
| 3,259,864 | 7/1966 | Marzolf et al. | 336/192 |
| 3,265,999 | 8/1966 | Kessel | 336/192 |
| 3,566,322 | 2/1971 | Horbach | 336/192 |
| 3,731,245 | 5/1973 | Roslin | 336/192 |
| 3,742,412 | 6/1973 | Lakin | 336/192 |
| 3,824,519 | 7/1974 | Miller | 336/192 |
| 4,334,208 | 6/1982 | Post | 336/192 |

FOREIGN PATENT DOCUMENTS

| | | | |
|---|---|---|---|
| 1414821 | 3/1969 | Fed. Rep. of Germany | 336/192 |
| 2328227 | 12/1974 | Fed. Rep. of Germany | 336/192 |
| 1345472 | 10/1963 | France | 336/192 |
| 1240795 | 7/1971 | United Kingdom | 336/198 |
| 1243690 | 8/1971 | United Kingdom | 336/208 |

*Primary Examiner*—Thomas J. Kozma

[57] ABSTRACT

A transformer bobbin is described for holding one or more tapped windings so as to present a low profile. The bobbin includes a coil form which supports the windings and which carries at its ends an upper flange and a lower flange between which the windings are disposed. A plurality of spaced apart fingers are formed at least on the lower flange by slots which extend to the periphery of the lower flange. A terminal strip is carried by the lower flange beneath the fingers so that tap loops from a winding may each be passed through one of the slots and then to the terminal strip where each loop may be joined to an external lead.

3 Claims, 7 Drawing Figures

LOW PROFILE TRANSFORMER BOBBIN

BACKGROUNDD OF THE INVENTION

This invention is directed to an improved bobbin for a transformer of the type used in television receivers and other types of electronic equipment.

Electronic equipment such as television receivers typically includes at least one transformer which has four or more taps thereon. Because of the construction of the transformer bobbin and the manner in which the taps are taken from the transformer, the outside dimensions of the transformer tend to be relatively large. This effect is explained more readily by reference to FIG. 1.

The transformer 10 illustrated in FIG. 1 includes windings 12 supported on a conventional bobbin 14. To simplify the drawing, only a single winding is shown although it will be understood that the transformer will usually have at least two windings.

To establish a tap on the transformer 10, a loop 16 is extended from the winding 12 and twisted around and soldered to a lead 18. Tape is wound around the junction between the loop 16 and the lead 18 and around the other transformer windings to insulate the lead 18 from windings which carry a substantially higher or lower voltage.

Three or more additional taps are made in the same manner by bringing out loops 20, 22 and 24 and coupling them to leads 26, 28 and 30, respectively. Because of the bulk associated with the leads 18, 26, 28 and 30 and the tape required for their insulation, the transformer bulges outwardly as indicated by the dashed line 32.

Although transformers built as described above perform satisfactorily, their drawback lies in their undesirably large size. Transformers having a multiplicity of taps usually bulge to an extent which renders them impractical for use in low profile equipment packages.

Accordingly, it is a general object of the invention to provide an improved transformer bobbin.

It is a more specific object of the invention to provide a bobbin adapted to provide a reduced profile for a tapped transformer wound thereon.

BRIEF DESCRIPTION OF THE FIGURES

The objects stated above and other objects of the invention are set forth in the following detailed description and in the accompanying drawings in which.

DESCRIPTION OF THE PREFERRED EMBODIMENT

Figure 1:
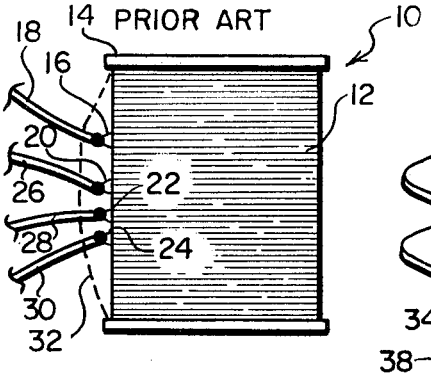
FIG.1 PRIOR ART
FIG. 1, previously referred to, illustrates a transformer wound on a conventional bobbin.
Figure 2:
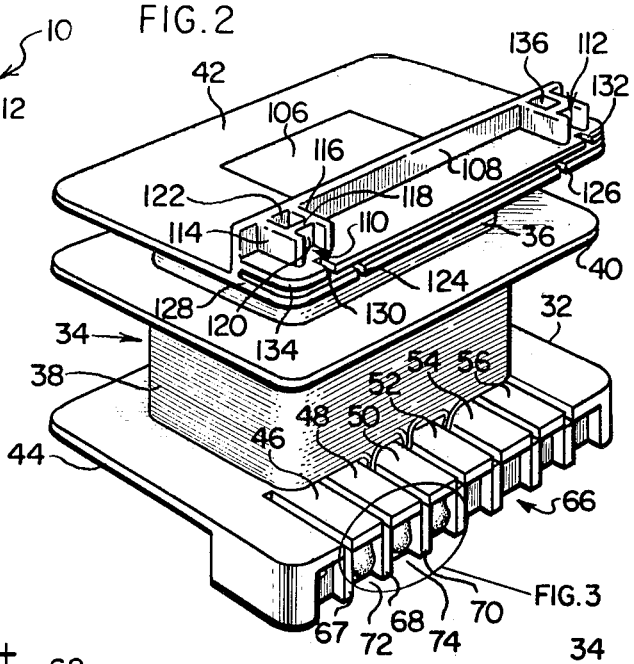
FIG. 2 is a perspective view of a transformer bobbin according to the invention, including a tapped winding on the bobbin.

Referring to FIG. 2, a bobbin 32 is shown for holding a transformer in a manner which provides a low profile package. The illustrated bobbin includes a hollow coil form 34 which is shown as carrying a primary winding 36 and a secondary winding 38 on its outer surface. These two windings may be separated from each other by a plate 40 which is integrally molded with the coil form.

Figure 3:
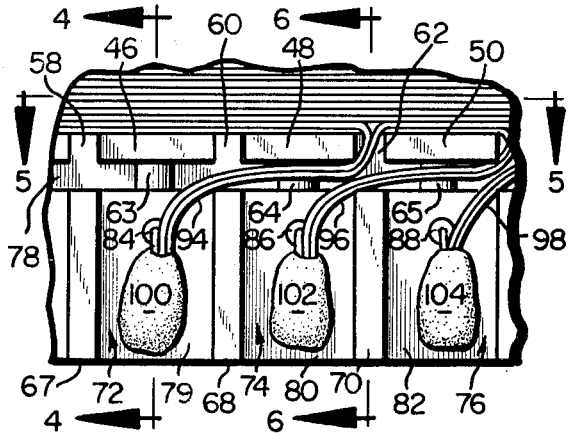
FIG. 3 is an enlarged fragmentary view of the portion of the bobbin which is circled in FIG. 2.

The coil form 34 carries an upper flange 42 and a lower flange 44 which contain the windings on the form. Referring more specifically to the lower flange 44, it has a plurality of fingers 46, 48, 50, 52, 54 and 56 which are formed by slots in the lower flange 44 which preferably extend to the periphery of the lower flange. FIG. 3 depicts exemplary slots 58, 60 and 62 defining fingers 46, 48 and 50. These and the other fingers are supported by underlying ribs such as ribs 63, 64, and 65.

Carried by the lower flange 44 is a terminal strip 66 which is situated directly beneath the fingers 46 through 56. This terminal strip 66 is divided into a plurality of electrically isolated terminal compartments by side walls. For example, side walls 67, 68 and 70 divide the portion of the terminal strip shown in FIG. 3 into terminal compartments 72, 74 and 76. It is in these compartments that leads from the secondary winding 34 are joined to external tap leads as described more fully below.

The compartments in the terminal strip 66 are open at their tops to communicate with a channel 78 (see FIGS. 3 and 4) which extends the length of the terminal strip 66. This channel also communicates with the slots between the fingers 46 through 56 to carry leads from the winding 34 to various terminal compartments via the slots and the channel 78.

Figure 4:
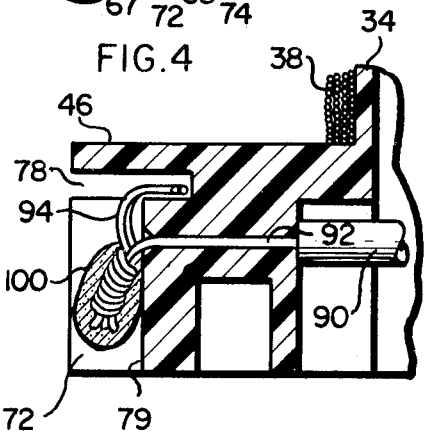
FIG. 4 is a sectional view taken along lines 4—4 of FIG. 3.
Figure 5:
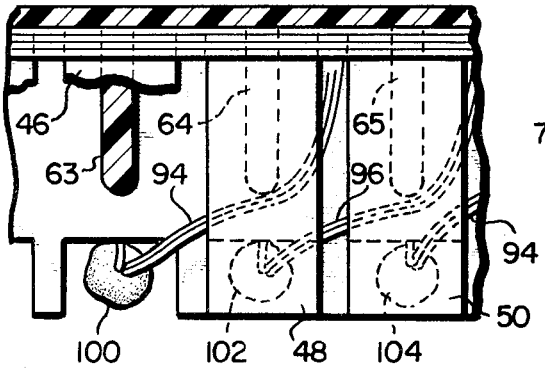
FIG. 5 is a sectional view taken along lines 5—5 of FIG. 3.
Figure 6:
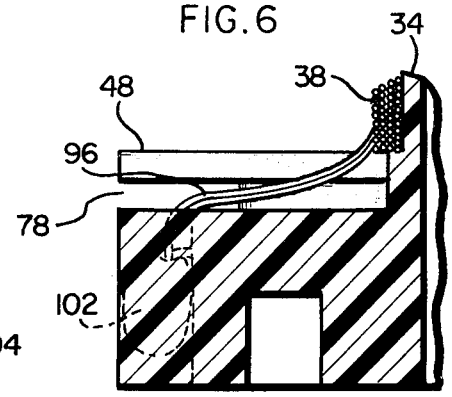
FIG. 6 is a sectional view taken along lines 6—6 of FIG. 3.

As shown most clearly in FIGS. 3 and 4, each of the terminal compartments in the terminal strip 66 includes an apertured rear wall through which an external tap lead is fed for joining to one of the leads from the secondary winding 34. For example, terminal compartments 72, 74 and 76 include respective rear walls 79, 80 and 82 in which apertures 84, 86 and 88 are formed. An insulated external tap lead 90 (FIG. 4) is fed to the rear of the terminal strip 66, and its inner conductor 92 is fed through the aperture 84 into the compartment 72 where it is joined to a winding loop 94 from the secondary winding 38. Similarly, external leads are fed through apertures 86 and 88 into compartments 80 and 82 to join other winding loops 96 and 98 from the secondary winding 38.

The winding loop 94 and other similar loops are fed into their respective terminal compartments as follows. The loop 94 is extended from the secondary winding 38 at a point where a tap is intended to be made, as is done conventionally. The loop 94 is then passed through the slot 62 into the channel 78. This loop is extended along the channel 78 and inserted into the terminal compartment 72. The end of the loop 94 may be twisted to the external lead 92 as shown in FIG. 4 and further joined thereto by means of a solder connection 100.

The loops 96 and 98 are fed into the terminal compartments 74 and 76 in a similar manner via their respective slots and the chnnel 78. Solder connections 102 and 104 may be used to join the loops 96 and 98 to external tap leads which are fed into compartments 74 and 76 via apertures 86 and 88.

With the arrangement described above, it can be seen that the bulging associated with the formation of taps on a conventional bobbin is avoided. All tap loops are extended downwardly to the terminal strip 66 where they are joined to external tap leads. In addition, the illustrated embodiment avoids the use of insulating tape because the various tap loops are insulated from each other and the transformer windings. As shown in FIG. 3, for example, the loop 94 does not overlie any other loops or any windings on the secondary winding 38. It is insulated from those windings by the fingers 46, 48 and insulated from the adjacent loop 96 by the side wall 68. The loops 96 and 98 are similarly insulated from the secondary windings and from any other loops which may be extended from the secondary winding.

Referring now to the upper flange 42, it may include an aperture 106 which communicates with a similarly shaped aperture within the coil form 34 to hold a magnetic core therein. Mounted on the upper flange 42 is another terminal strip 108 for joining leads from the primary winding 36 to external leads. The strip 108 includes a plurality of terminal compartments such as compartments 110 and 112. The compartment 110 is formed by side walls 114 and 116 and a rear wall 118 through which an aperture 120 is formed. This aperture communicates with a recess 122 bounded by the side walls 114 and 116 and another upstanding rear wall.

The upper flange 42 also includes slots 124 and 126 and a plate 128 in which slots 130 and 132 are formed. As shown, a channel 134 is formed below the plate 128 for communicating with the slots 124, 126, 130 and 132.

To use the terminal strip 108, a lead (not shown) from the primary winding 36 may be extended from the coil form through the slot 124, into the channel 134, and then run horizontally down the channel 134 to reach the slot 130. That lead is then fed through the slot 130 upwardly into the compartment 110. An external lead (not shown) may be inserted into the recess 122, fed into the compartment 110 via the aperture 120 and then joined in the compartment 110 to the lead from the primary winding. Another lead from the primary winding may be fed through the slot 126, into the compartment 112 via the slot 126, the channel 134 and the slot 132. Another external lead may be joined to the primary winding in the compartment 112 by inserting it into a recess 136 whence it may be fed into the compartment 112 via an aperture (not shown) in a rear wall of the compartment 112. With this arrangement, bulging due to the formation of taps on the primary winding is eliminated in a manner described previously for the secondary winding.

Figure 7:
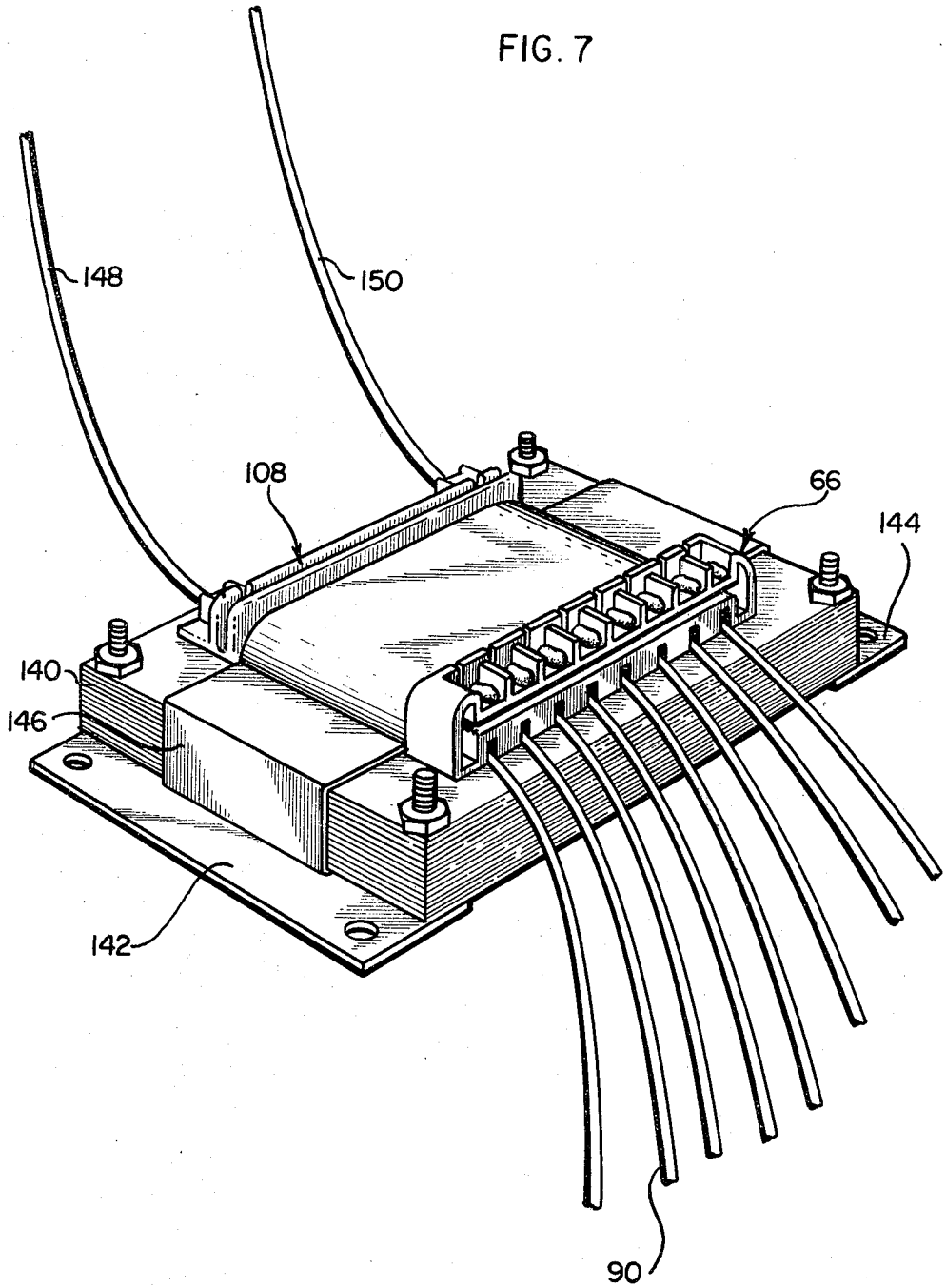
FIG. 7 is a perspective view of a fully assembled transformer including a core and the bobbin shown in FIG. 1.

Referring now to FIG. 7, a fully assembled transformer is shown to illustrate the low profile that is obtained by use of the present bobbin. As shown, the bobbin is substantially enclosed by an iron core 136 which may carry mounting brackets 142 and 144. A copper flux band 146 may be included to cover the windings carried by the bobbin. External leads 148 and 150 are coupled to the transformer's primary winding at the upper terminal strip 108. The lower terminal strip 66 receives the external tap lead 90 in addition to any of the other illustrated tap leads for coupling to taps on the secondary winding.

Because of the low profile provided by the bobbin and its accompanying winding or windings, the transformer thus formed may be readily used in low profile equipment housings. It may also be used in any other type of equipment housing where it is desired to save space.

Although the invention has been described in terms of a preferred embodiment, it will be obvious to those skilled in the art that many alterations and modifications may be made without departing from the invention. Accordingly, it is intended that all such modifications and alterations be considered as within the spirit and scope of the invention as defined by the appended claims.

What is claimed is:

1. A transformer bobbin adapted for receiving at least one winding having a plurality of winding loops, comprising:

a coil form for supporting said at least one winding thereon;

an upper flange and a lower flange carried by opposite ends of the coil form for containing the winding on the coil form;

a plurality of fingers formed in the lower flange, said fingers being defined by slots in the lower flange which extend to the periphery of the lower flange; and a terminal strip carried by the lower flange beneath said fingers, said terminal strip including a rear wall disposed in perpendicular relation to and extending between the distal ends of said lower flange, a plurality of spaced side walls each extending perpendicularly from said rear wall and aligned beneath a respective one of said slots, said rear and side walls dividing the strip into a plurality of electrically isolated terminal compartments, said compartments being spaced from said fingers by a channel extending between the distal ends of said lower flange such that each of said winding loops may be passed through a respective one of said slots and thence along said channel and into a different one of said compartments, said rear wall including a plurality of apertures each of which extends in spaced parallel relation beneath a respective one of said fingers such that each aperture communicates with one terminal compartment, whereby a tap lead may be fed into a compartment via one of said apertures for connection to a winding loop.

2. A bobbin as set forth in claim 1 wherein said upper flange has a plurality of slots extending to the periphery thereof, and wherein the upper flange carries a terminal strip for receiving winding leads eminating from the winding supported by the coil form and passing through said slots.

3. A bobbin as set forth in claim 2 wherein said terminal strip is spaced from the upper flange by a channel, and wherein the terminal strip is divided into a plurality of terminal compartments each communicating with the channel so that winding leads from the coil form may be passed through the slots in the upper flange, into the channel, and then to individual terminal compartments.

* * * * *